US010767388B2

(12) United States Patent
Witherby

(10) Patent No.: US 10,767,388 B2
(45) Date of Patent: Sep. 8, 2020

(54) UNIVERSAL RIM HOUSING LOCKING SYSTEM

(71) Applicant: Paul Witherby, Miami, FL (US)

(72) Inventor: Paul Witherby, Miami, FL (US)

(73) Assignee: T-Concepts Solutions, Inc., Miami, FL (US)

( * ) Notice: Subject to any disclaimer, the term of this patent is extended or adjusted under 35 U.S.C. 154(b) by 238 days.

(21) Appl. No.: 16/054,584

(22) Filed: Aug. 3, 2018

(65) Prior Publication Data

US 2020/0040601 A1 Feb. 6, 2020

(51) Int. Cl.

*E05B 3/00* (2006.01)
*E05B 9/10* (2006.01)
*E05B 9/00* (2006.01)

(52) U.S. Cl.

CPC ..... *E05B 3/003* (2013.01); *E05B 9/002* (2013.01); *E05B 9/10* (2013.01)

(58) Field of Classification Search

CPC . E05B 3/003; E05B 9/002; E05B 9/10; E05B 3/00

USPC ..... 70/370, 372, 374, 379 R, 380, 461, 466, 70/450–452

See application file for complete search history.

(56) References Cited

U.S. PATENT DOCUMENTS 769,770 A * 9/1904 Phelps ..... E05B 15/0245 292/341.18
2,213,262 A * 9/1940 Segal ..... E05B 17/041 70/461
3,541,820 A * 11/1970 Best ..... E05B 9/086 70/369
4,663,953 A * 5/1987 Fish ..... E05B 17/04 70/216
4,672,828 A * 6/1987 Theriault ..... E05B 9/086 70/373
4,926,670 A * 5/1990 Deforrest, Sr. ..... E05B 63/006 70/374
5,010,749 A * 4/1991 Lin ..... E05B 63/0017 70/190

(Continued)

FOREIGN PATENT DOCUMENTS

EP 751272 * 1/1997 ..... E05B 9/00
FR 2729428 * 7/1996 ..... E05C 9/06

OTHER PUBLICATIONS

CRL US Aluminum: "Locking Ladder Pulls"; published no later than Aug. 2, 2018.

*Primary Examiner* — Suzanne L Barrett
(74) *Attorney, Agent, or Firm* — Bryan W. Bockhop; Bockhop Intellectual Property Law, LLC

(57) ABSTRACT

A handle assembly includes a lock cylinder of a selected one of a first standard or a different second standard. A tail piece extends from the lock cylinder. The handle assembly also includes a vertical tubular member, a horizontal tubular member and a transition plate. The transition plate is disposed within the vertical tubular member and is moveable between a first position and a different second position. The transition plate accommodates installation of the lock cylinder of the first standard when in the first position and installation of the lock cylinder of the second standard when in the second position. A mechanical linkage is coupled to the tail piece and effects movement of a locking bolt in response to turning of a key in the lock cylinder.

9 Claims, 3 Drawing Sheets

(56) References Cited

U.S. PATENT DOCUMENTS

| | | | | |
|---|---|---|---|---|
| 5,029,460 | A * | 7/1991 | Anastasiou | E05B 15/1614 70/451 |
| 5,233,851 | A * | 8/1993 | Florian | E05B 9/084 70/367 |
| 6,684,669 | B1 * | 2/2004 | Talpe | E05B 9/00 292/1.5 |
| 7,347,069 | B2 * | 3/2008 | Talpe | E05B 17/2088 70/107 |
| 8,240,178 | B2 * | 8/2012 | Massard | E05B 9/04 70/370 |
| 8,978,848 | B2 * | 3/2015 | Teng | F16F 9/342 188/266 |
| 9,670,693 | B2 * | 6/2017 | Degre | E05B 17/04 |
| 10,415,267 | B1 * | 9/2019 | Schmutz | E05B 63/08 |
| 2009/0044579 | A1 * | 2/2009 | Hartman | E05B 17/04 70/367 |

* cited by examiner

UNIVERSAL RIM HOUSING LOCKING SYSTEM

BACKGROUND OF THE INVENTION

1. Field of the Invention

The present invention relates to locking systems and, more specifically, to a locking system that can accommodate locks of different standards.

2. Description of the Related Art

One common type of locking mechanism used in door locks is the cylinder-based rim lock. Such locks include a cylinder housing a tumbler mechanism that engages a tail piece, which turns when a compatible key is turned in the tumbler mechanism. The tail piece engages a mechanical linkage that causes a bolt to move in and out of a bolt receptacle (typically mounted in a door jam or a floor), depending on the position of the tail piece.

As shown in FIG. 1, a typical existing handle for a glass door 62 includes two vertically-aligned tubes 23 and 64, one on each side of the door 62, that serve as gripping structures and a pair of spaced-apart horizontally-aligned tubes 22 affixed to each of the vertically-aligned tubes 23 and 64. Each of the horizontally-aligned tubes is coupled to a corresponding horizontally-aligned tube through a hole in the door 62.

If the door 62 is provided with a rim lock-type lock cylinder 26, the lock cylinder 26 is secured to one of the vertically-aligned tubes 23 in alignment with one of the horizontally-aligned tubes 22. A tubular core housing sleeve can extend from the vertically-aligned tube to cover part of the lock cylinder 26. The lock cylinder 26 is coupled to a mechanical linkage 66 in the opposite vertically-aligned tube 64, which is coupled to a bolt 68 that engages a locking plate 70 either below the door 62 in the floor 60 or above the door 62.

One type of an existing locking system for a door 62 (such as a glass door) includes a vertical pull tube 23 (only a portion of which is shown, but which acts as the structure that one grabs when opening or closing a door) and a transverse tube 22. A lock cylinder 26 (also referred to herein as a "core lock housing") fits into a hole defined by the vertical pull tube 23 and a tail piece 40 extends from the lock cylinder 26. The tail piece 40 engages a mechanical linkage 66 (shown greater in detail in FIG. 3) used to actuate the position of the locking bolt 68. A securing plate 52 is affixed to one of the vertical pull tube 23 or the transverse tube 25. The securing plate 52 defines a first hole 56 for the tail piece 40 to pass through and at least one screw hole 54 (typically two screw holes are used) to secure the lock cylinder 26 to the securing plate 52 using securing screws 21.

As shown in FIGS. 2A and 2B, there are two main standards used for securing lock cylinders to tubes used in the door handles. One standard includes LFIC locks made by Yale, Schlage, Primus, and Medco, as well as most rim housing locks. A second standard includes LFIC locks made by Sargent and Corbin, as well as most SFIC locks. They differ mainly in the locations of the set screws 224 in the backs of the cylinders used to secure the lock cylinders 26*a* and 26*b* to the door handles. As a result, door handles are manufactured to fit one of the two different lock cylinder standards.

When an architect or contractor orders door handles for doors used in new construction, the architect must order handles and lock cylinders that fit each other. Unfortunately, if a building manager or a tenant later decides to order locks of a different locking standard, then new handles that are compatible with the new standard must be ordered and the entire handle assembly for each door must be changed.

Therefore, there is a need for universal rim lock mounting system that can accommodate lock cylinders of more than one standard.

SUMMARY OF THE INVENTION

The disadvantages of the prior art are overcome by the present invention which, in one aspect, is a transition plate for use with a lock cylinder having a back portion with a tail piece extending therefrom, the lock cylinder being installable in a platform. The transition includes a plate member having an front shape configured to interface the back portion of the lock cylinder. The plate member defines a first tail piece hole passing therethrough and at least one first set screw hole spaced apart from the first tail piece hole in a first predetermined relationship thereto so as to correspond to a first lock cylinder standard. The plate member also defines a second tail piece hole passing therethrough and at least one second set screw hole spaced apart from the second tail piece hole in a second predetermined relationship thereto so as to correspond to a second lock cylinder standard different from the first lock cylinder standard. The plate member also defines a first position holding screw hole and a second position holding screw hole spaced apart from the first position holding screw hole in a spatial relationship so that the plate member is held in a first position relative to the platform when the first position holding screw hole is aligned with a platform position holding screw hole and in a second position relative to the platform when the second position holding screw hole is aligned with the platform position holding screw hole. When the plate member is in the first position the first tail piece hole is in a position to allow the tail piece of a lock cylinder of a first standard to pass therethrough and the first set screw hole is aligned with a cylinder set screw hole defined by the lock cylinder of first standard, and when the plate member is in the second position the second tail piece hole is in a position to allow the tail piece of a lock cylinder of a second standard, different from the first standard, to pass therethrough and the second set screw hole is aligned with a cylinder set screw hole defined by the lock cylinder of second standard.

In another aspect, the invention is a handle assembly that includes a lock cylinder of a selected one of a first standard or a different second standard. A tail piece extends from the lock cylinder. The handle assembly also includes a vertical tubular member, a horizontal tubular member and a transition plate. The transition plate is disposed within the vertical tubular member and is moveable between a first position and a different second position. The transition plate accommodates installation of the lock cylinder of the first standard when in the first position and installation of the lock cylinder of the second standard when in the second position. A mechanical linkage is coupled to the tail piece and effects movement of a locking bolt in response to turning of a key in the lock cylinder.

In yet another aspect, the invention is a door employing door locking system for use with a selected one of a lock cylinder of a first standard and a lock cylinder of a second standard, different from the first standard, the lock cylinder of a first standard and the lock cylinder of a second standard each including a tail piece extending laterally therefrom. The door includes a lock cylinder of a selected one of a first standard or a different second standard, a tail piece extending therefrom, a first vertical tubular member and a horizontal tubular member. A transition plate is disposed within the vertical tubular member. The transition plate is moveable between a first position and a different second position. The transition plate accommodates installation of the lock cylinder of the first standard when in the first position and installation of the lock cylinder of the second standard when in the second position. A bolt has a locked position and an unlocked position for locking the door. A mechanical linkage couples the tail piece to the bolt. When the lock cylinder is manipulated to unlock the door, the mechanical linkage causes the bolt to move into the unlocked position and wherein the lock cylinder is manipulated to lock the door, the mechanical linkage causes the bolt to move into the locked position.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
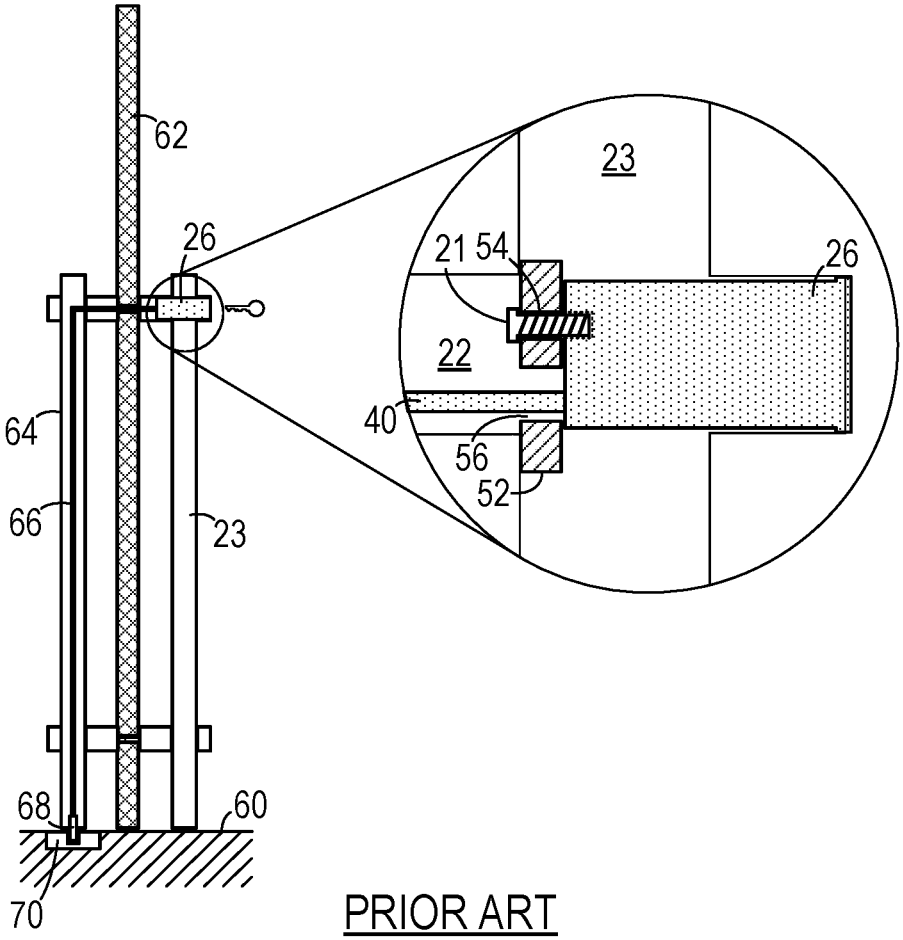
PRIOR ART FIG. 1
FIG. 1 is a schematic view of a prior art door locking assembly.
Figure 2A:
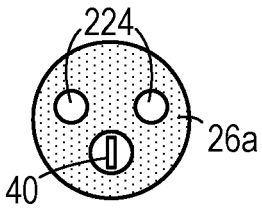
PRIOR ART FIG. 2A
FIGS. 2A and 2B are schematic views of the back sides of lock cylinders of two different standards.
Figure 2B:
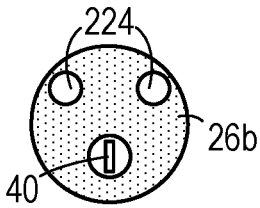
PRIOR ART FIG. 2B

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on." The terms "tubular" and "tube" are defined herein to include any elongated substantially hollow structure, which can include both a cylindrical structure having circular cross-section and a structure having a non-circular cross-section. Examples of such non-circular cross-sections include: an elliptical cross-section, a square cross-section, a rectangular cross-section, a polygonal cross-section and an irregular cross-section. As used herein, "tubular" and "tube" include all elongated substantially hollow structures.

Figure 3:
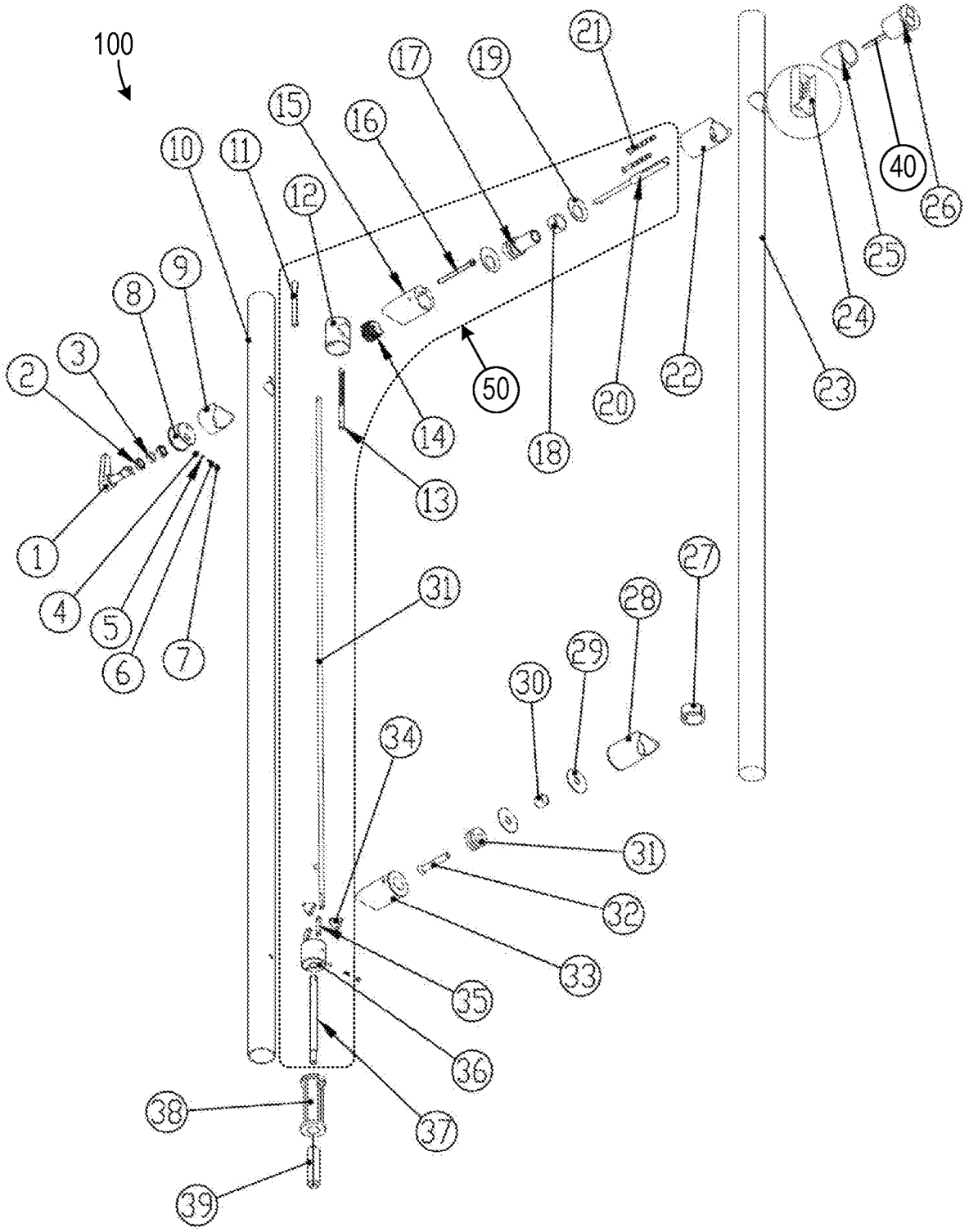
FIG. 3 is an exploded view of one embodiment of a door handle assembly.

As shown in FIG. 3, one embodiment of the invention includes a door handle system 100 that employs a transition plate 24 to allow for installation of lock cylinders 26 of different standards. The following table lists the item numbers and part names shown in FIG. 3.

| Item No. | Part Name |
|---|---|
| 1 | ADA Lever turn |
| 2 | Bearings |
| 3 | Brass Washer |
| 4 | Position Ball |
| 5 | Brass cushion |
| 6 | Spring |
| 7 | Screw |
| 8 | Lever turn housing |
| 9 | Lever turn housing sleeve |
| 10 | Inside tubing |
| 11 | Short Rack |
| 12 | Gear Housing |
| 13 | Long Rack |
| 14 | Gear |
| 15 | J Inner-upper post |
| 16 | Screw for fixing Lever turn (M5) |
| 17 | Upper Axis (M18) |
| 18 | Upper Bushing |
| 19 | Upper washers |
| 20 | Connection Rod |
| 21 | Screw for fixing Core |
| 22 | Horizontal tubular member, also referred to as: Outer-upper post |
| 23 | Vertical tubular member, also referred to as: Outer tubing |
| 24 | Brass Universal Mount-Transition Plate |
| 25 | Core-housing Sleeve |
| 26 | Lock cylinder, also referred to as: Lock-Core Housing |
| 27 | Inside Ring |
| 28 | Outer-bottom post |
| 29 | Washer |
| 30 | Bottom bushing |
| 31 | Brass Axis (M25) |
| 32 | Threaded rod (M8) |
| 33 | Inner-bottom post |
| 34 | Anti-push Triangle |
| 35 | Bolt Positioning piece |
| 36 | Anti-push Fixing Blcok |
| 37 | Bolt Extension Rod |
| 38 | Bolt Sleeve |
| 39 | Bolt |
| 40 | Tail piece |
| 50 | Mechanical linkage |

Figure 4A:
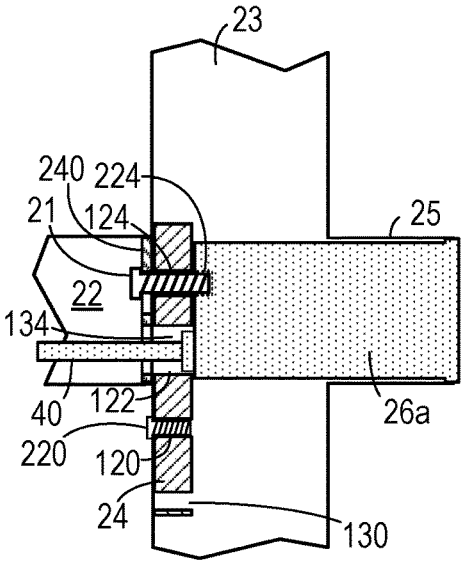
FIG. 4A is a schematic view of a door locking assembly employing a lock cylinder of a first standard.
Figure 4B:
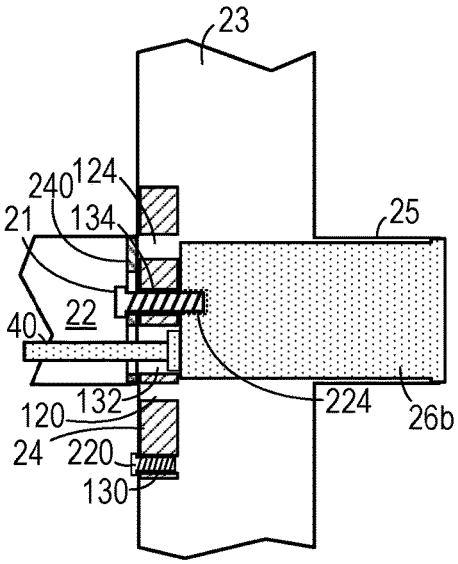
FIG. 4B is a schematic view of a door locking assembly employing a lock cylinder of a second standard.

As shown in FIGS. 4A and 4B, the locking mechanism includes a plate member 24 is used for securing the lock cylinder 26*a* or 26*b* (depending on the lock cylinder standard used) to the vertical tube member 23. The plate member defines a first tail piece hole 122 to accommodate the tail piece 40 extending from lock cylinder 26*a* (a lock cylinder of the first standard shown in FIG. 4A) and a second tail piece hole 132 to accommodate the tail piece 40 extending from lock cylinder 26*b* (a lock of the second standard shown in FIG. 4B). The plate member also defines a first pair of set screw holes 124 that align with the set screw holes 224 of the lock cylinder of the first standard 26*a* and a second pair of set screw holes 134 that align with the set screw holes 224 of the lock cylinder of the second standard 26*b*. The plate member 24 defines a first position holding screw hole 120 and a second position holding screw hole 130. When a set screw 220 is screwed into the first position holding screw hole 120, the plate member 24 is held in the first position and when the set screw 220 is screwed into the second position holding screw hole 130, the plate member 24 is held in the second position.

Figure 5:
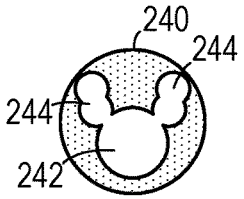
FIG. 5 is a schematic view of an interface plate of an outer-upper post.

When installing a lock cylinder 26*a* or 26*b*, the installer moves the plate member 24 into the position corresponding to the lock standard being used and secures the set screw 220 into the appropriate position holding screw hole 130 or 120. The installer then inserts the set screws 21 through the set screw holes (124 or 134, depending upon the lock standard) and screws them into the set screw holes 224 in the lock cylinder 26*a* or 26*b*. As shown in FIG. 5, horizontally-aligned tube 22 can include back plate 240 that is affixed thereto. The back plate 240 can include a tail piece opening 242 and set screw openings 244. During installation, the transition plate is effectively secured to the horizontally-aligned tube 22 by being affixed to the back plate 240 by the set screws 21.

Figure 6A:
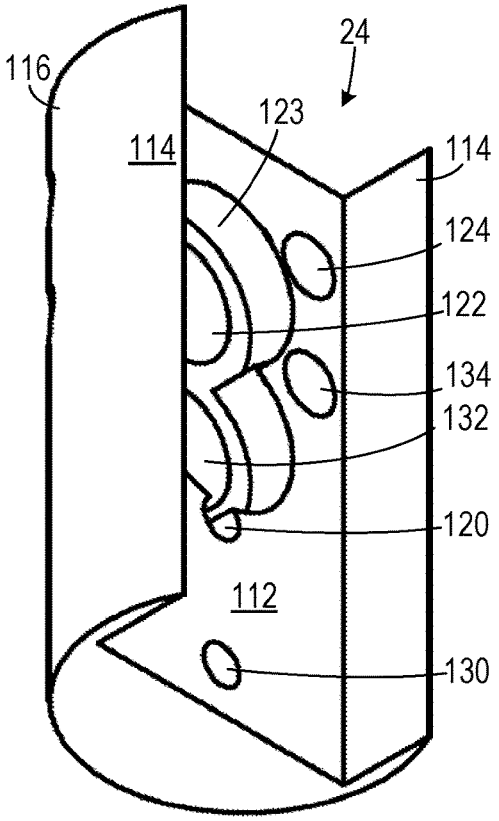
FIG. 6A is a front left side perspective view of a transition plate.
Figure 6B:
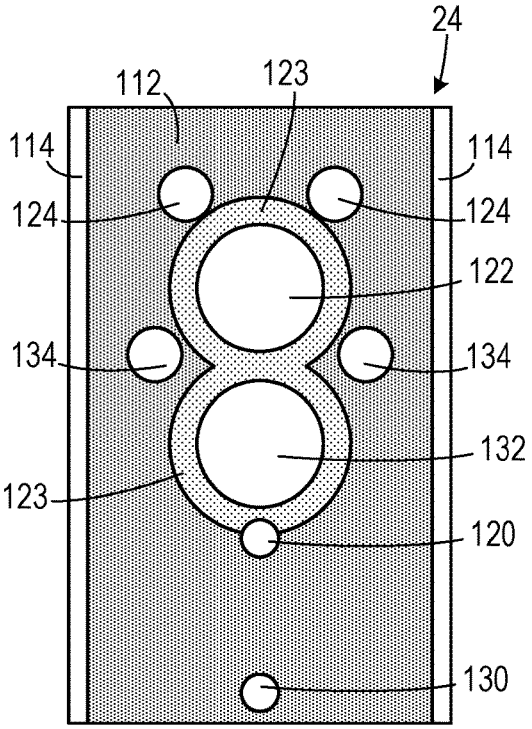
FIG. 6B is a front elevational schematic view of the transition plate shown in FIG. 6A.

The transition plate 24 is shown in greater detail in FIGS. 6A and 6B. It includes a front surface 112 that fits against the back of the lock cylinder 26*a* or 26*b* and an opposite back surface 116 that conforms to the shape of the vertical tubular member 23. A pair of extensions 114 can extend outwardly from the front surface 112 to facilitate easy assembly. Also, a depression 123 may be routed about the tail piece holes 122 and 132 to accommodate any protrusions from the lock cylinder associated with the tail piece 22.

As will be appreciated by those of skill in the art, the tubular members and the transition plate 24 may be made of any appropriate material, depending upon the specific application, including, but not limited to: stainless steel, aluminum, brass, other metals, composites, ceramics, plastics and combinations thereof.

While the embodiments shown accommodate installation of lock cylinders of two different standards, it is understood that the invention could be adapted to accommodate lock cylinders of multiple standards in excess of two standards without departing from the scope of the invention.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A transition plate for use with a lock cylinder having a back portion with a tail piece extending therefrom, the lock cylinder being installable in a platform, the transition plate comprising:

(a) a plate member having a front shape configured to interface the back portion of the lock cylinder;

(b) the plate member defining a first tail piece hole passing therethrough and at least one first set screw hole spaced apart from the first tail piece hole in a first predetermined relationship thereto so as to correspond to a first lock cylinder standard;

(c) the plate member defining a second tail piece hole passing therethrough and at least one second set screw hole spaced apart from the second tail piece hole in a second predetermined relationship thereto so as to correspond to a second lock cylinder standard different from the first lock cylinder standard; and (d) the plate member defining a first position holding screw hole and a second position holding screw hole spaced apart from the first position holding screw hole in a spatial relationship so that the plate member is held in a first position relative to the platform when the first position holding screw hole is aligned with a platform position holding screw hole and in a second position relative to the platform when the second position holding screw hole is aligned with the platform position holding screw hole, wherein when the plate member is in the first position the first tail piece hole is in a position to allow the tail piece of a lock cylinder of a first standard to pass therethrough and the first set screw hole is aligned with a cylinder set screw hole defined by the lock cylinder of first standard, and wherein when the plate member is in the second position the second tail piece hole is in a position to allow the tail piece of a lock cylinder of a second standard, different from the first standard, to pass therethrough and the second set screw hole is aligned with a cylinder set screw hole defined by the lock cylinder of second standard.

2. The transition plate of claim 1, further comprising a back shape configured to fit against the platform.

3. The transition plate of claim 2, wherein the back shape is hemi-cylindrical.

4. The transition plate of claim 1, wherein the platform comprises a tubular door handle.

5. A handle assembly, comprising:

(a) a lock cylinder of a selected one of a first standard or a different second standard, a tail piece extending therefrom;

(b) a vertical tubular member;

(c) a horizontal tubular member;

(d) a transition plate disposed within the vertical tubular member, the transition plate moveable between a first position and a different second position, in which the transition plate accommodates installation of the lock cylinder of the first standard when in the first position and installation of the lock cylinder of the second standard when in the second position; and (e) a mechanical linkage coupled to the tail piece that effects movement of a locking bolt in response to turning of a key in the lock cylinder, wherein the transition plate comprises:

(f) a plate member having a front shape configured to interface the back portion of the lock cylinder;

(g) the plate member defining a first tail piece hole passing therethrough and at least one first set screw hole spaced apart from the first tail piece hole in a first predetermined relationship thereto so as to correspond to a first lock cylinder standard;

(h) the plate member defining a second tail piece hole passing therethrough and at least one second set screw hole spaced apart from the second tail piece hole in a second predetermined relationship thereto so as to correspond to a second lock cylinder standard different from the first lock cylinder standard; and (i) the plate member defining a first position holding screw hole and a second position holding screw hole spaced apart from the first position holding screw hole in a spatial relationship so that the plate member is held in the first position relative to the platform when the first position holding screw hole is aligned with a platform position holding screw hole and in the second position relative to the platform when the second position holding screw hole is aligned with the platform position holding screw hole, and wherein when the plate member is in the first position the first tail piece hole is aligned with the tail piece and the first set screw hole is aligned with a cylinder set screw hole defined by the lock cylinder of first standard and wherein when the plate member is in the second position the second tail piece hole is aligned with the tail piece and the second set screw hole is aligned with a cylinder set screw hole defined by the lock cylinder of second standard.

6. The handle assembly of claim 5, wherein the vertical tubular member is cylindrical and wherein the transition plate has a back shape that is hemi-cylindrical.

7. A door employing door locking system for use with a selected one of a lock cylinder of a first standard and a lock cylinder of a second standard, different from the first standard, the lock cylinder of a first standard and the lock cylinder of a second standard each including a tail piece extending laterally therefrom, the door comprising:

(a) a planar door member;

(b) a lock cylinder of a selected one of a first standard or a different second standard, a tail piece extending therefrom;

(c) a first vertical tubular member;

(d) a horizontal tubular member that couples the first vertical tubular member to the planar door member;

(e) a transition plate disposed within the vertical tubular member, the transition plate moveable between a first position and a different second position, in which the transition plate accommodates installation of the lock cylinder of the first standard when in the first position and installation of the lock cylinder of the second standard when in the second position;

(f) a bolt having a locked position and an unlocked position for locking the door;

(g) a mechanical linkage coupling the tail piece to the bolt, wherein when the lock cylinder is manipulated to unlock the door, the mechanical linkage causes the bolt to move into the unlocked position and wherein when the lock cylinder is manipulated to lock the door, the mechanical linkage causes the bolt to move into the locked position;

(h) a plate member having a front shape configured to interface the back portion of the lock cylinder;

(i) the plate member defining a first tail piece hole passing therethrough and at least one first set screw hole spaced apart from the first tail piece hole in a first predetermined relationship thereto so as to correspond to a first lock cylinder standard;

(j) the plate member defining a second tail piece hole passing therethrough and at least one second set screw hole spaced apart from the second tail piece hole in a second predetermined relationship thereto so as to correspond to a second lock cylinder standard different from the first lock cylinder standard; and (k) the plate member defining a first position holding screw hole and a second position holding screw hole spaced apart from the first position holding screw hole in a spatial relationship so that the plate member is held in the first position relative to the platform when the first position holding screw hole is aligned with a platform position holding screw hole and in the second position relative to the platform when the second position holding screw hole is aligned with the platform position holding screw hole, and wherein when the plate member is in the first position the first tail piece hole is aligned with the tail piece and the first set screw hole is aligned with a cylinder set screw hole defined by the lock cylinder of first standard and wherein when the plate member is in the second position the second tail piece hole is aligned with the tail piece and the second set screw hole is aligned with a cylinder set screw hole defined by the lock cylinder of second standard.

8. The door of claim 7, wherein the vertical tubular member is cylindrical and wherein the transition plate has a back shape that is hemi-cylindrical.

9. The door of claim 7, further comprising a second vertical tubular member disposed on an opposite side of the door from the first vertical tubular member and through which a portion of the mechanical linkage passes.

* * * * *